US007552987B2

(12) United States Patent
Nakata et al.

(10) Patent No.: US 7,552,987 B2
(45) Date of Patent: Jun. 30, 2009

(54) LIQUID EJECTING APPARATUS AND CONTROL METHOD AND PROGRAM OF THE SAME

(75) Inventors: Satoshi Nakata, Nagano-ken (JP); Hitoshi Igarashi, Nagano-ken (JP); Yoshiyuki Kimoto, Nagano-ken (JP); Koji Niioka, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 240 days.

(21) Appl. No.: 11/364,019

(22) Filed: Feb. 27, 2006

(65) Prior Publication Data

US 2006/0203025 A1 Sep. 14, 2006

(30) Foreign Application Priority Data

Feb. 28, 2005 (JP) ..... 2005-053571
Mar. 15, 2005 (JP) ..... 2005-072782

(51) Int. Cl.
*B41J 29/393* (2006.01)

(52) U.S. Cl. ..... 347/19

(58) Field of Classification Search ..... None
See application file for complete search history.

(56) References Cited

U.S. PATENT DOCUMENTS 5,925,889 A * 7/1999 Guillory et al. ..... 250/559.16
6,935,713 B2 * 8/2005 Phillips ..... 347/7
2005/0225626 A1 10/2005 Igarashi et al.

FOREIGN PATENT DOCUMENTS

| | | |
|---|---|---|
| EP | 1 285 767 | 2/2003 |
| JP | 08-211788 | 8/1996 |
| JP | 2000-289252 | 10/2000 |
| JP | 2003-127341 | 5/2003 |
| JP | 2003-260829 | 9/2003 |
| JP | 2004-314410 | 11/2004 |
| JP | 2005-022210 | 1/2005 |

OTHER PUBLICATIONS

European Search Report, Re: EP 06 00 3919.

* cited by examiner

*Primary Examiner*—Matthew Luu
*Assistant Examiner*—Justin Seo
(74) *Attorney, Agent, or Firm*—John J. Penny, Jr.; Catherine J. Toppin

(57) ABSTRACT

There is provided a liquid ejecting apparatus for ejecting liquid to a printing material, having a platen for supporting the printing material, an ejection head for ejecting the liquid to the printing material by reciprocating on the printing material supported by the platen, an optical sensor reciprocating together with the ejection head and having a light emitting section for emitting light toward the printing material and the platen and a light receiving section for receiving light reflected from the printing material to optically detect whether or not the printing material exists, a usage measuring section for measuring usage of the liquid ejecting apparatus and a correcting section for correcting a result detected by the optical sensor based on the usage measured by the usage measuring section.

19 Claims, 10 Drawing Sheets

LIQUID EJECTING APPARATUS AND CONTROL METHOD AND PROGRAM OF THE SAME

CROSS REFERENCE TO RELATED APPLICATIONS

The present application claims priority from Japanese patent applications No. 2005-053571 filed on Feb. 28, 2005 and 2005-072782 filed on Mar. 15, 2005, the contents of which are incorporated herein by reference.

BACKGROUND OF THE INVENTION

1. Field of the Invention

The present invention relates to a liquid ejecting apparatus and to a control method and a program of the same. More specifically, the invention relates to a liquid ejecting apparatus and to a control method and a program of the same for ejecting liquid to a printing material.

2. Related Art

Conventionally, as an example of a liquid ejecting apparatus, there has been known an ink-jet printing apparatus that ejects ink to a printing material to print thereon. With regard the ink-jet printing apparatus, there has been known so-called edgeless printing of printing the printing material without leaving margins at four corners thereof. The ink-jet printing apparatus capable of carrying out the edgeless printing has a sensor for detecting edges of the printing material and ejects ink to the outside of the edges by adding a certain margin at the edges of the printing material detected based on the sensor.

However, accuracy of the sensor for detecting the edges of the printing material drops due to such reasons that the sensor is contaminated by ink and the like as usage of the ink-jet printing apparatus that carries out the edgeless printing increases. A quantity of emitting light and a quantity of receiving light drop as the detecting precision drops when an optical sensor is used in particular, so that the optical sensor detects the inside of the printing material as its edge as the precision drops. In order to deal with that, there has been a method of ejecting ink to the outside of the edge of the printing material with a certain margin by presupposing a detection error in detecting the edge of the printing material as disclosed in Japanese Patent Laid-Open Nos. 2004-314410 and 2003-127341 for example.

However, the methods disclosed in Japanese Patent Laid-Open Nos. 2004-314410 and 2003-12734 have had a problem that the ink-jet printing apparatus ejects ink to the outside of the printing material, wasting a considerable amount of ink, when there is not so much detection error, i.e., when the ink-jet printing apparatus is not used so much. The above-mentioned methods have had also a problem that the sensor for detecting the edge of the printing material is liable to be contaminated, dropping the detecting precision drops further, by ejecting much useless ink.

SUMMARY OF THE NVENTION

In order to solve the above-mentioned problems, according to a first aspect of the invention, there is provided a liquid ejecting apparatus for ejecting liquid to a printing material, having a platen for supporting the printing material, an ejection head for ejecting the liquid to the printing material by reciprocating on the printing material supported by the platen, an optical sensor reciprocating together with the ejection head and having a light emitting section for emitting light toward the printing material and the platen and a light receiving section for receiving light reflected from the printing material to optically detect whether or not the printing material exists, a usage measuring section for measuring usage of the liquid ejecting apparatus and a correcting section for correcting a result detected by the optical sensor based on the usage measured by the usage measuring section. Thereby, it becomes possible to accurately detect whether or not the printing material exists even when the usage increases and the detecting precision of the optical sensor varies as time elapses.

In the liquid ejecting apparatus, the correcting section may correct the result on the supposition that the printing material exists on the outside of the printing material detected by the optical sensor as the usage increases. Thereby, it becomes possible to accurately detect whether or not the printing material exists even when the detecting precision of the optical sensor drops.

The liquid ejecting apparatus described above may be arranged so that the correcting section corrects the result detected whether or not the printing material exists in a direction in which the optical sensor reciprocates. Thereby, it becomes possible to accurately detect the width of the printing material in the direction in which the ejection head reciprocates even when the detecting precision of the optical sensor drops.

The liquid ejecting apparatus may further include a transferring section for conveying the printing material in a direction crossing at right angles with the direction in which the optical sensor reciprocates and the correcting section may correct the result detected whether or not the printing material exists in the direction in which the printing material is conveyed. Thereby, it becomes possible to accurately detect the width of the printing material in the conveying direction even when the detecting precision of the optical sensor drops.

The liquid ejecting apparatus may be arranged so that the usage measuring section measures the usage by measuring a light emitting time of the light emitting section. In this case, the usage measuring section may calculate the light emitting time by measuring a power-on time. Thereby, it becomes possible to correct the detected result whether or not the printing material exists based on the contamination caused by ink, which is one of causes of degradation of the detecting precision of the optical sensor.

The liquid ejecting apparatus may be arranged so that the usage measuring section calculates the usage by measuring an ejection amount of liquid ejecting out of the ejection head. At this time, the liquid ejecting apparatus described above may be arranged so that the usage measuring section calculates the ejection amount by counting a number of sheets of the printing material. Still more, the usage measuring section may calculate the ejection amount by measuring an amount of liquid ejecting out of the ejection head. Further, the usage measuring section may calculate the amount of the liquid based on an ejection mode. Thereby, it becomes possible to correct the detection result whether or not the printing material exists based on the drop of the quantity of light to be emitted, which is one of causes of degradation of the detecting precision of the optical sensor.

The liquid ejecting apparatus described above may be arranged so that the correcting section minutely corrects the result when the detecting resolution of the optical sensor is high. Thereby, it becomes possible to accurately correct the result to the limit of the detecting resolution of the optical sensor.

The correcting section may determine a range into which the liquid is ejected to the printing material based on the correction. Thereby, the edgeless printing may be carried out with a small margin regardless of the detecting precision of the optical sensor whether it is high or low.

According to a second aspect of the invention, there is provided a control method for controlling a liquid ejecting apparatus for ejecting liquid to a printing material, having steps of optically detecting whether the printing material exists by an optical sensor by reciprocating the optical sensor on the printing material supported by a platen, by emitting light toward the printing material and the platen and by receiving the light reflected from the printing material by a light receiving section, measuring usage of the liquid ejecting apparatus and correcting a result detected by the optical sensor based on the usage. Thereby, the same effect with the first aspect may be obtained.

According to a third aspect of the invention, there is provided a computer program for controlling a liquid ejecting apparatus for ejecting liquid to a printing material, realizing a function of optically detecting whether the printing material exists by an optical sensor by reciprocating the optical sensor on the printing material supported by a platen, by emitting light toward the printing material and the platen and by receiving the light reflected from the printing material by a light receiving section, a function of measuring usage of the liquid ejecting apparatus and a function of correcting a result detected by the optical sensor based on the usage. Thereby, the same effect with the first aspect may be obtained. According to a fourth aspect of the invention, there is provided a liquid ejecting apparatus for ejecting liquid to a printing material, having a platen for supporting the printing material, an ejection head for ejecting the liquid to the printing material by reciprocating on the printing material supported by the platen, an optical sensor reciprocating together with the ejection head and having a light emitting section for emitting light toward the printing material and the platen, a light receiving section for receiving light reflected from the printing material and a comparing section for comparing intensity of light received by the light receiving section with a threshold value to optically detect whether or not the printing material exists, a usage measuring section for measuring usage of the liquid ejecting apparatus and a correcting section for correcting a result detected by the optical sensor based on the usage measured by the usage measuring section. Thereby, it becomes possible to accurately detect whether or not the printing material exists even when the usage increases and the detecting precision of the optical sensor varies as time elapses.

The liquid ejecting apparatus described above may be arranged so that the correcting section corrects the threshold value in a direction in which the intensity of light is weakened as the usage increases. Thereby, it becomes possible to accurately detect whether or not the printing material exists even when the detecting accuracy of the optical sensor drops.

The liquid ejecting apparatus may be arranged so that the correcting section corrects the threshold value in detecting whether or not the printing material exists in the direction in which the optical sensor reciprocates. Thereby, it becomes possible to accurately detect the width of the printing material in the direction in which the ejection head reciprocates even when the detecting precision of the optical sensor drops.

The liquid ejecting apparatus may further include a transferring section for conveying the printing material in a direction crossing at right angles with the direction in which the optical sensor reciprocates and the correcting section may correct a threshold value for detecting whether or not the printing material exists in the direction in which the printing material is conveyed. Thereby, it becomes possible to accurately detect the width of the printing material in the conveying direction even when the detecting precision of the optical sensor drops.

The liquid ejecting apparatus may be arranged so that the usage measuring section measures the usage by measuring the light emitting time of the light emitting section. In this case, the usage measuring section may calculate the light emitting time by measuring a power-on time. Thereby, it becomes possible to correct the detected result whether or not the printing material exists based on the contamination caused by ink, which is one of causes of degradation of the detecting precision of the optical sensor.

The liquid ejecting apparatus may be arranged so that the usage measuring section calculates the usage by measuring an ejection amount of the liquid ejecting out of the ejection head. At this time, the liquid ejecting apparatus described above may be arranged so that the usage measuring section calculates the ejection amount by counting a number of sheets of the printing material.

Still more, the usage measuring section may calculate the ejection amount by measuring an amount of liquid ejecting out of the ejection head. Further, the usage measuring section may calculate the amount of the liquid based on an ejection mode. Thereby, it becomes possible to correct the detection result whether or not the printing material exists based on the drop of the quantity of emitted light, which is one of causes of degradation of the detecting precision of the optical sensor.

Further, the liquid ejecting apparatus described above may be arranged so that the correcting section minutely corrects the result when the detecting resolution of the optical sensor is high. Thereby, it becomes possible to accurately correct the result to the limit of the detecting resolution of the optical sensor.

The correcting section may determine a range into which the liquid is ejected to the printing material based on the correction. Thereby, the edgeless printing may be carried out with a small margin regardless of the detecting precision of the optical sensor whether it is high or low.

According to a fifth aspect of the invention, there is provided a control method for controlling a liquid ejecting apparatus for ejecting liquid to a printing material, having steps of optically detecting whether or not the printing material exists by an optical sensor by reciprocating the optical sensor on the printing material supported by a platen, by emitting light toward the printing material and the platen, by receiving the light reflected from the printing material by a light receiving section and by comparing intensity of light received by the light receiving section with a threshold, measuring usage of the liquid ejecting apparatus and correcting a result detected by the optical sensor based on the usage. Thereby, the same effect with the fourth aspect may be obtained.

According to a sixth aspect of the invention, there is provided a computer program for controlling a liquid ejecting apparatus for ejecting liquid to a printing material, realizing a function of optically detecting whether the printing material exists by an optical sensor by reciprocating the optical sensor on the printing material supported by a platen, by emitting light toward the printing material and the platen, by receiving the light reflected from the printing material by a light receiving section, and by comparing intensity of light received by the light receiving section with a threshold value, a function of measuring usage of the liquid ejecting apparatus and a function of correcting a result detected by the optical sensor based on the usage. Thereby, the same effect with the fourth aspect may be obtained.

It is noted that the summary of the invention described above does not necessarily describe all necessary features of the invention. The invention may also be a sub-combination of the features described above.

DETAILED DESCRIPTION OF THE INVENTION

The invention will now be described based on preferred embodiments, which do not intend to limit the scope of the invention, but exemplify the invention. All of the features and the combinations thereof described in the embodiments are not necessarily essential to the invention.

Figure 1:
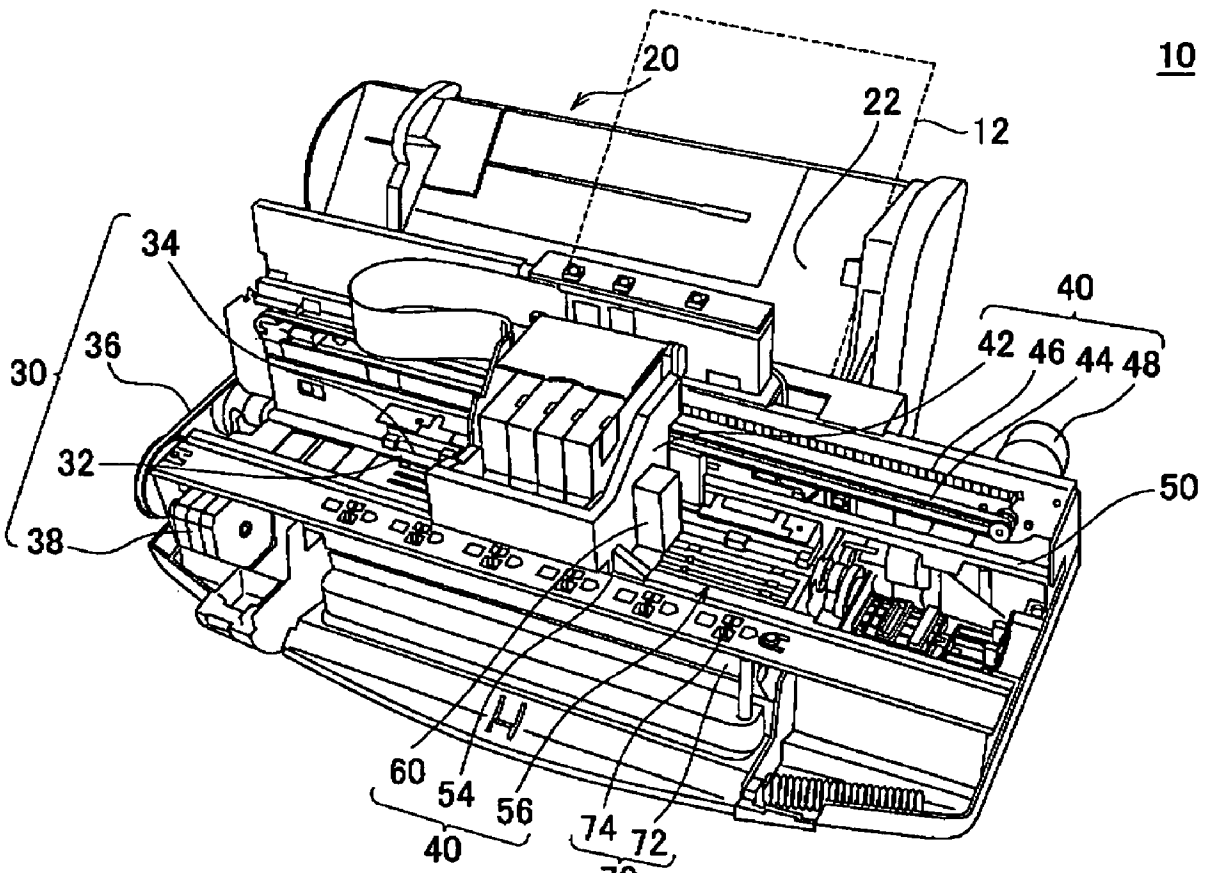
FIG. 1 is a perspective view of an ink-jet printing device.

FIG. 1 is a perspective view showing an ink-jet printing apparatus 10 that is one exemplary liquid ejecting apparatus according to an embodiment of the invention. An object of the present embodiment is to provide the ink-jet printing apparatus 10 that prints a printing material 12 by ejecting ink thereto and is capable of detecting whether or not the printing material 12 exists even when usage of the ink-jet printing apparatus 10 increases and detecting precision of an optical sensor 60 varies as time elapses.

As shown in FIG. 1, the ink-jet printing apparatus 10 has a sheet feeding section 20, a transferring section 30, a printing section 40 and a discharging section 70 in order from an upstream side in terms of direction in conveying the printing material 12. The ink-jet printing apparatus 10 also has a control section 100 for controlling them.

The sheet feeding section 20 has a sheet-feeding tray 22 for supporting the printing material 12 stacked thereon and a sheet-feeding roller not shown for conveying the printing material 12 supported by the sheet-feeding tray 22 to the transferring section 30 one by one. The transferring section 30 has a transfer motor 38 for generating rotary driving force, a transfer belt 36 linked with the transfer motor 38, a transfer driving roller 32 linked with the transfer belt 36 to be rotated and a rotatable transfer driven roller 34 disposed so as to face to the transfer driving roller 32. The discharging section 70 has a rotatable discharge driving roller 72 linked with the transfer belt 36 and a rotatable discharge driven roller 74 disposed so as to face to the discharge driving roller 72.

The printing section 40 has a platen 56 disposed underneath thereof, a carriage 42 that reciprocates on the platen 56, a recording head 54 disposed underneath the carriage 42 and an optical sensor 60 disposed on the side face of the carriage 42. The recording head 54 and the optical sensor 60 reciprocate on the platen 56 together with the carriage 42 that reciprocates thereon. The printing section 40 also has a carriage motor 48 that generates rotary driving force, a timing belt 44 that is wrapped around the carriage motor 48 and is linked with the carriage 42, a micro strip 46 that extends along the reciprocating direction of the carriage 42 and a carriage guide 50 for guiding the reciprocation of the carriage 42. The micro strip 46 has a plurality of stripe patterns that extends in a short direction at equal intervals in a longitudinal direction.

The carriage 42 is capable of removably storing ink cartridges 49. The ink cartridge 49 stores ink therein and feeds the ink to the recording head 54. The ink cartridges 49 store a plurality of kinds of inks separately in order to print the printing material 12 in color. For example, the four ink cartridges 49 for storing four kinds inks of yellow, magenta, cyan and black are shown in FIG. 1 for example. However, the kind of ink is not limited to them. The other kinds of ink accommodated in the ink cartridges 49 include eight types of inks of yellow, magenta, cyan, mat-black, glazing black, red, violet and glazing (transparent). The recording head 54 is provided with a plurality of nozzles and each one of the plurality of kinds of ink is ejecting out of either one nozzle.

In the ink-jet printing apparatus 10 shown in FIG. 1, the printing material 12 is stacked on the sheet-feeding tray 22. The transfer driving roller 32 receives driving force of the transfer motor 38 driven based on the control of the control section 100 via the transfer belt 36 and pinches the uppermost printing material 12 stacked on the sheet feeding tray 22 between the transfer driven roller 34 to convey under the recording head 54 and above the platen 56. At this time, the platen 56 guides the printing material 12 underneath the recording head 54 and supports the printing material 12 from the underneath of the printing material 12. In the state in which the printing material 12 is conveyed on the platen 56, the carriage motor 48 rotatably drives the timing belt 44 and the carriage 42 linked with the timing belt 44 reciprocates on the printing material 12 while being guided by the carriage guide 50. While the carriage 42 reciprocates, the recording head 54 disposed underneath the carriage 42 ejects ink toward the printing material 12. Then, the printing material 12 is printed as the ink ejecting out of the recording head 54 reaches the printing material 12. After that, the ink-jet printing apparatus 10 prints the whole printing material 12 by repeating two operations of conveying the printing material 12 further by the transferring section 30 and of ejecting the ink by the recording head 54. Then, the discharge driving roller 72 receives the driving force of the transfer motor 38 driven based on the control from the control section 100 via the transfer belt 36 and pinches the printing material 12 between it and the discharge driven roller 74 to discharge in front of the ink-jet printing apparatus 10.

Figure 2:
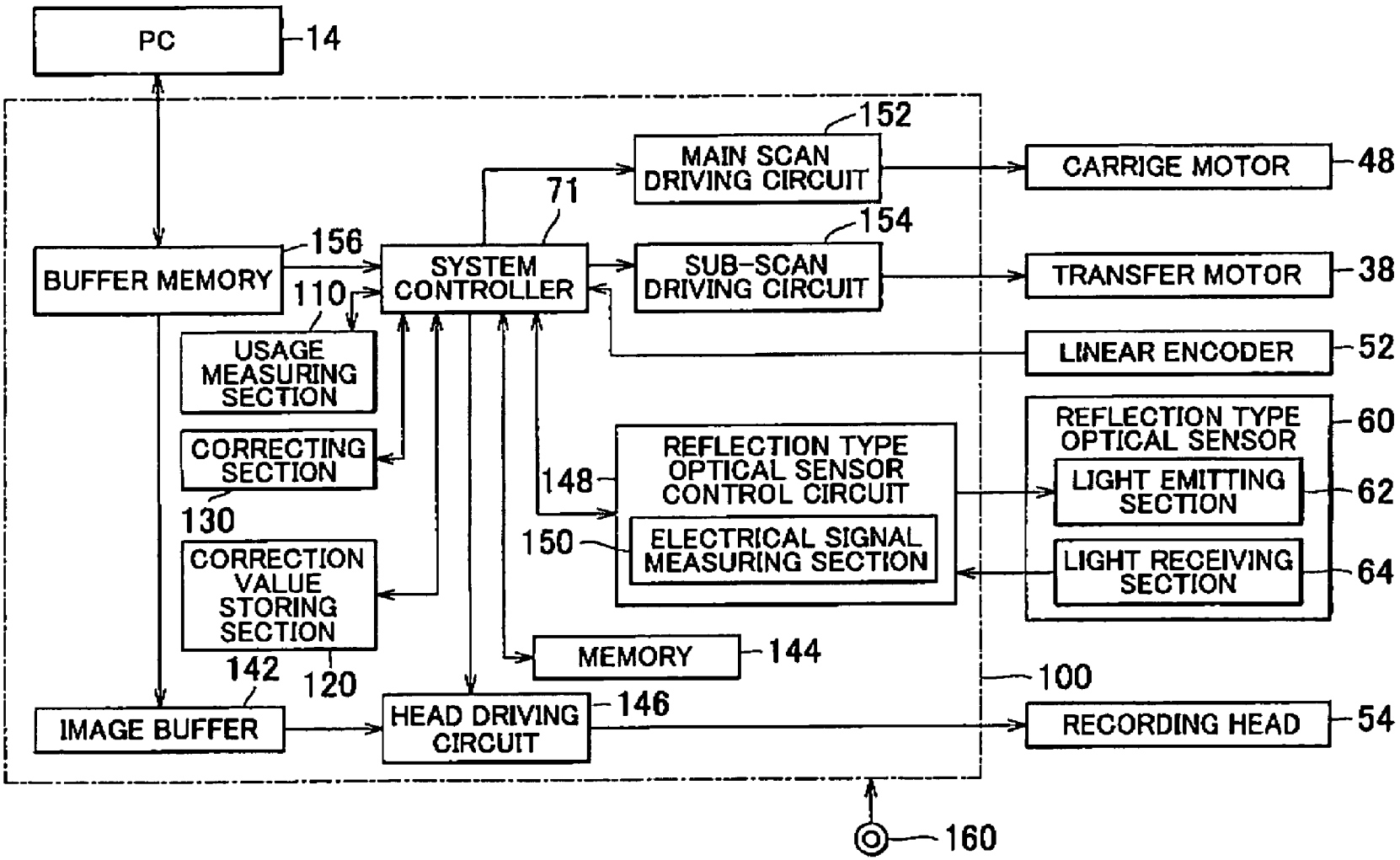
FIG. 2 is a block diagram showing functional blocks of a control section of the ink-jet printing apparatus.

FIG. 2 is a block diagram showing functional blocks of the control section 100 of the ink-jet printing apparatus 10. The control section 100 has a buffer memory 156 for receiving signals fed from a personal computer 14, an image buffer 142 for storing printing data, a system controller 140 for controlling operations of the whole ink-jet printing apparatus 10 and a memory 144. The system controller 140 is also connected with a main scan driving circuit 152 for driving the carriage motor 48, a sub-scan driving circuit 154 for driving the transfer motor 38, a head driving circuit 146 for driving the recording head 54, an optical sensor control circuit 148 for controlling a light emitting section 62 and a light receiving section 64 of the optical sensor 60 and an encoder 52. The optical sensor control circuit 148 also has an electrical signal measuring section 150 for measuring the electrical signal transduced from reflected light received by the light receiving section 64.

In the configuration described above, printing data transferred from the personal computer 14 is stored once in the buffer memory 156. Then, the system controller 140 reads the information out of the buffer memory 156 and based on this, sends control signals to the main scan driving circuit 152, the sub-scan driving circuit 154, the head driving circuit 146 and others. The image buffer 142 stores printing data of a plurality of color components received by the buffer memory 156. The head driving circuit 146 reads out the printing data of each color component out of the image buffer 142 in accordance to the control signal from the system controller 140 and corresponding to that, drives the nozzle of each color provided in the recording head 54. The encoder 52 is disposed in the carriage 42 and reciprocates together with the reciprocation of the carriage 42. At this time, the encoder 52 counts a number of the strip patterns provided in the micro strip 46 and sends the measured value to the system controller 140. Thereby, the system controller 140 recognizes how far the carriage 42 is located from its home position.

The control section 100 also has a usage measuring section 110 for measuring usage of the ink-jet printing apparatus 10, a correction value storing section 120 for storing correction values corresponding to the usage of the ink-jet printing apparatus 10 and a correcting section 130 for correcting a result detected by the optical sensor 60 by making reference to the correction value storing section 120 based on an amount measured by the usage measuring section 110. In the present embodiment, the usage measuring section 110 counts a number of sheets of the printing material 12 printed by the ink-jet printing apparatus 10 and calculates it as the usage of the ink-jet printing apparatus 10. The correction value storing section 120 stores the correction value corresponding to the number of sheets of the printing material 12. Still more, the correcting section 130 makes reference to the correction value storing section 120 based on the number of sheets of the printing material 12 measured by the usage measuring section 110 to read out the correction value from the correction value storing section 120 and to make correction. Based on the correction, the correcting section 130 determines a range of the printing material 12 to which the ink ejects. That is, the correcting section 130 determines a range from position of the edge after the correction to that of a predetermined margin as the range to which the ink ejects and passes the position to the system controller 140. Thereby, the edgeless printing may be carried out with less margin even when the detecting precision of the optical sensor 60 is low.

The recording medium 160 stores programs for operating the usage measuring section 110, the correction value storing section 120 and the correcting section 130. The control section 100 may operate the usage measuring section 110, the correction value storing section 120 and the correcting section 130 by installing the programs stored in the recording medium 160. As another method, the control section 100 may obtain such programs via communication lines.

Figure 3A:
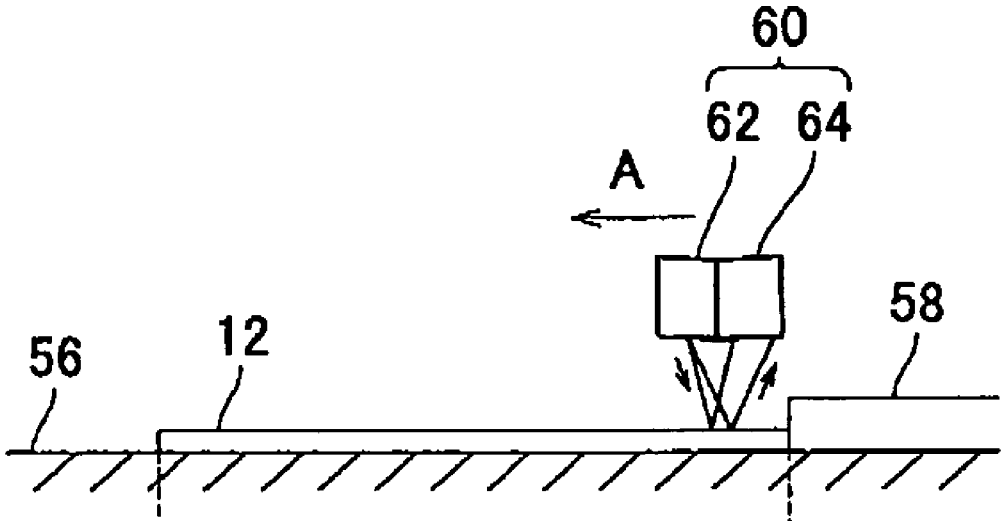
FIGS. 3A and 3B are schematic diagrams for explaining operations of an optical sensor in detecting whether or not a printing material exists.
Figure 3B:
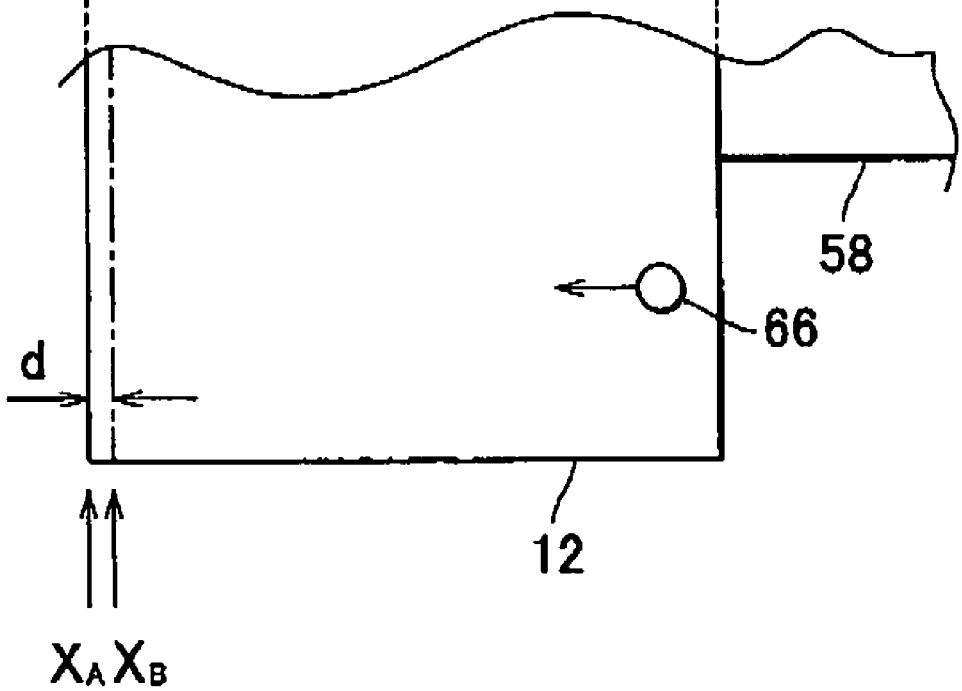

FIGS. 3A and 3B are schematic diagrams for explaining operations of the optical sensor 60 in detecting whether or not the printing material exists. Specifically, FIG. 3A a side view and FIG. 3B is a plan view thereof.

As shown in FIG. 3A, the optical sensor 60 reciprocates in the horizontal direction in the figure together with the carriage 42 shown in FIG. 1 on the printing material 12 placed on the platen 56. It is noted that the printing material 12 is positioned as its home position side (on the right side in the figure) abuts against an edge guide 58. Here, it is not necessary to detect by the optical sensor 60 the edge of the printing material 12 on the home position side.

Accordingly, an operation of the optical sensor 60 for detecting an edge of 80 columns (on the left side in the figure) will be explained below. The optical sensor 60 has the light emitting section 62 and the light receiving section 64. The light emitting section 62 may be a LED for example and illuminates the platen 56 and the printing material 12 supported on the platen 56. Thereby, as shown in FIG. 3B, an illumination area 66 having a certain area is formed on the platen 56 or on the printing material 12. Then, the light irradiated to the illumination area 66 is reflected by the platen 56 or the printing material 12 and the light receiving section 64 receives the light. Here, reflectance of the platen 56 is lowered by coloring the platen 56 in black for example so as to be able to judge whether the reflected light is what is reflected from the platen 56 having the low reflectance or what is reflected from the printing material 12 having high reflectance based on luminous energy of the reflected light. Here, because the illumination area 66 has the certain area, the luminous energy received by the light receiving section 64 gradually decreases until when the illumination area 66 comes out of the neighborhood of the edge of the printing material 12 totally to the platen 56.

Figure 4:
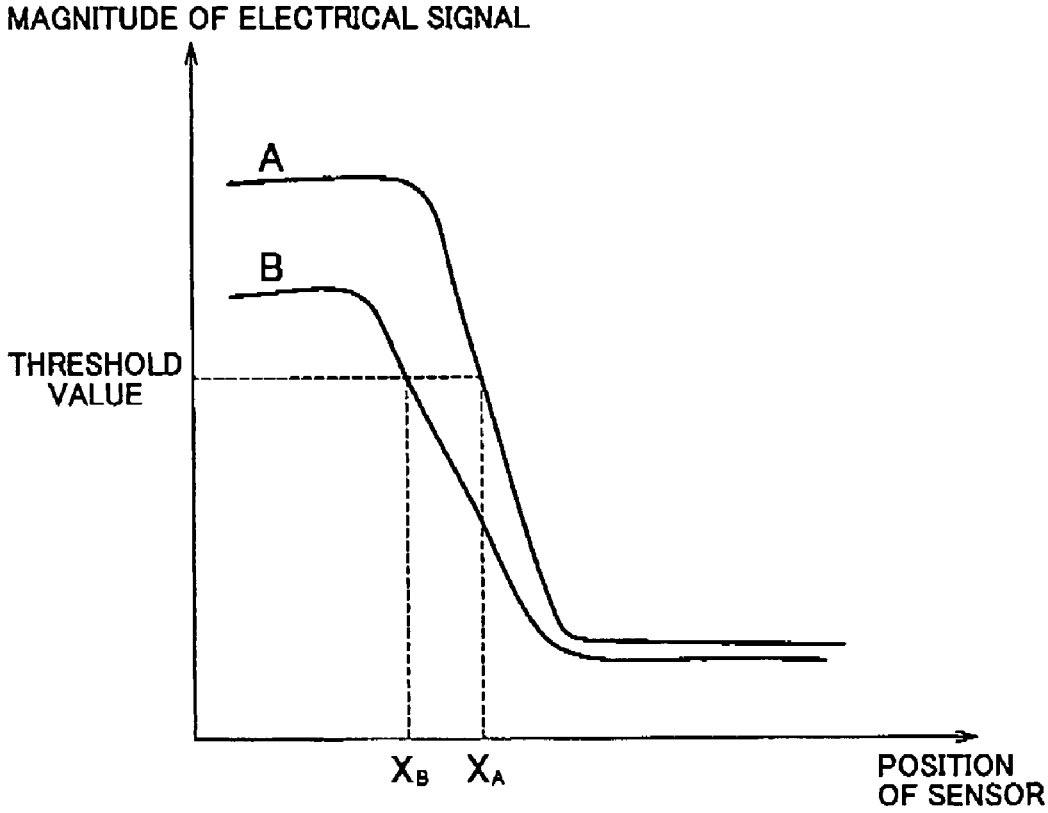
FIG. 4 is a graph for explaining a relationship between position (distance from home position) of the optical sensor and magnitude of electrical signals of an electrical signal measuring section.

FIG. 4 is a graph for explaining a relationship between the position (distance from home position) of the optical sensor 60 and magnitude of electrical signals of the electrical signal measuring section 150 when the luminous energy of light received by the light receiving section 64 is measured by transducing into the electrical signal by the electrical signal measuring section 150. When the usage of the ink-jet printing apparatus 10 is small and the detecting precision of the optical sensor 60 is not inferior, the electrical signal gradually changes at the left and left sides of position $X_A$ of the edge of the printing material 12 along a curve A as shown in FIG. 4 when the optical sensor 60 moves in the direction of A in FIG. 3A. Then, the system controller 140 measures the electrical signal of the electrical signal measuring section 150 in advance based on the luminous energy of light received by the light receiving section 64 when the optical sensor 60 comes to the position $X_A$ of the edge of the printing material 12 and stores it in advance as a threshold value so as to be able to judge that the light receiving section 64 is located on the printing material 12 when the electrical signal based on the luminous energy of received light of the light receiving section 64 is greater than this threshold value and that the optical sensor 60 is located on the platen 56 when the electrical signal is smaller than the threshold value.

However, when the usage of the ink-jet printing apparatus 10 increases, the detecting precision of the optical sensor 60 degrades as the ink adheres on the light emitting section 62 and the light receiving section 64 of the optical sensor 60. For example, the magnitude of the electrical signal of the electrical signal measuring section 150 based on the luminous energy of received light of the light receiving section 64 in the optical sensor 60 changes from the curve A to the curve B at certain usage as shown in FIG. 4. Then, the electrical signal of the electrical signal measuring section 150 becomes equal with the threshold value set in the curve A when the optical sensor 60 comes to the position $X_B$ in the curve B. Therefore, with the increase of the usage of the ink-jet printing apparatus 10 and the degradation of the detecting precision of the optical sensor 60, the electrical signal of the electrical signal measuring section 150 becomes equal with the threshold value described above at the inner position of the printing material 12 from the original edge position $X_A$ of the printing material 12.

In order to deal with that, the correcting section 130 of the present embodiment corrects the result detected by the optical sensor 60 based on the usage of the ink-jet printing apparatus 10. In this case, the correcting section 130 reads out the usage measured by the usage measuring section 110, reads out the correction value stored in the correction value storing section 120 corresponding to this usage and corrects the position by adding this correction value to the position detected based on the optical sensor 60. For example, in case when the usage of the ink-jet printing apparatus 10 is what causes the electrical signal of the electrical signal measuring section 150 to be like the curve B in FIG. 4, the correcting section 130 adds the correction value ($X_A$-$X_B$) stored in the correction value storing section 120 to the position $X_B$ of the optical sensor 60 where the electrical signal of the electrical signal measuring section 150 becomes equal with the threshold value based on the curve B and judges the position after the correction as the edge of the printing material 12. Thereby, it becomes possible to detect whether or not the printing material 12 exists, or more specifically the edge of the printing material 12, even when the usage of the ink-jet printing apparatus 10 increases and the detecting precision of the optical sensor 60 varies as time elapses. It is noted that although the case when the optical sensor 60 moves in the direction of the arrow A has been explained as an example, the correcting section 130 can correct even when the optical sensor 60 moves in the opposite direction from the arrow A in the same manner with the case when the optical sensor 60 moves in the direction of the arrow A because the magnitude of the electrical signal of the electrical signal measuring section 150 reaches the threshold value at the inner position of the printing material 12 as the accuracy of the optical sensor 60 degrades along with the usage of the ink-jet printing apparatus 10.

Figure 5:
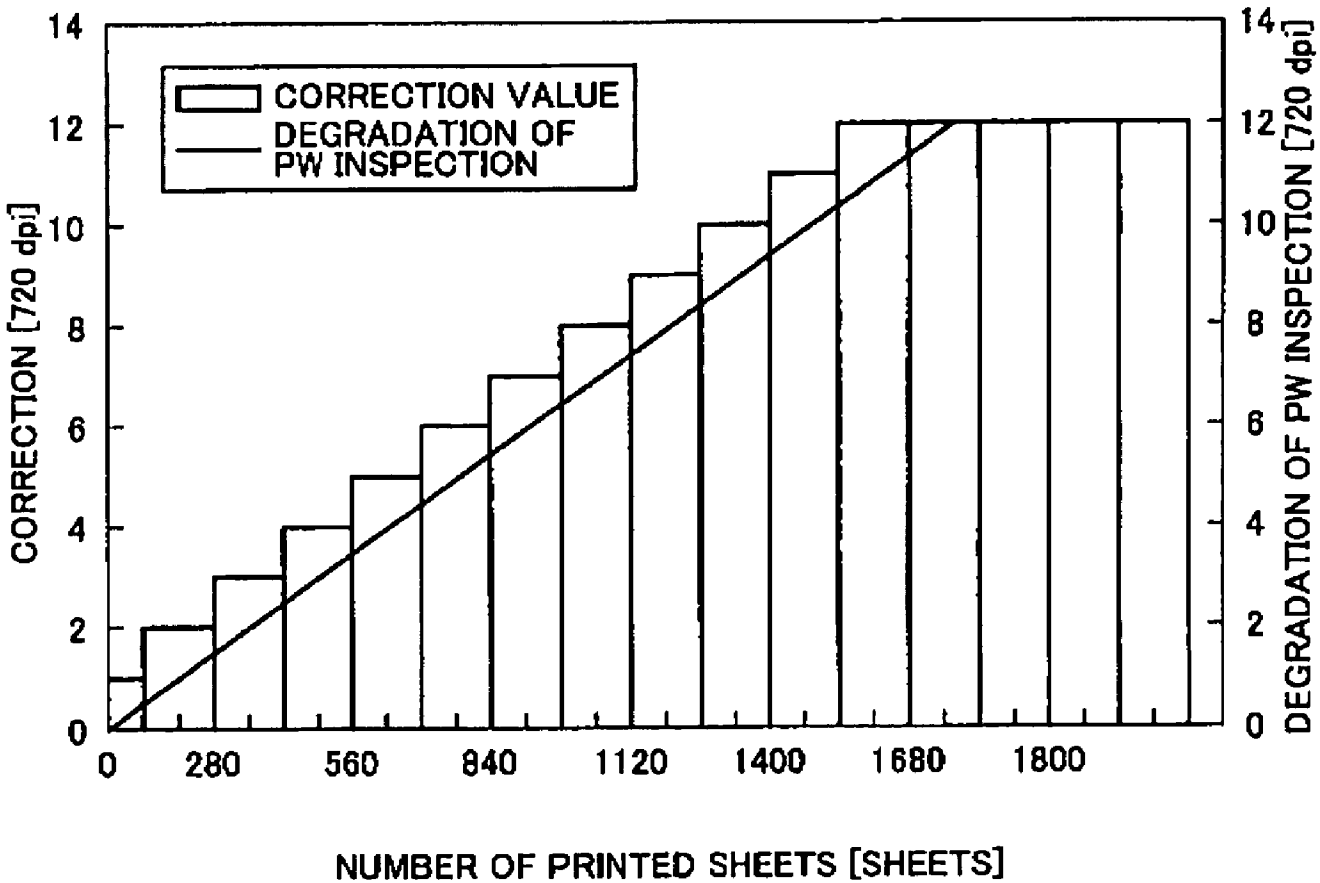
FIG. 5 is a graph showing exemplary correction values stored in a correction value storing section.

FIG. 5 is a graph showing the exemplary correction values stored in the correction value storing section 120. The correction value storing section 120 shown in connection with FIG. 5 stores the correction values in a direction of width of the printing material 12 (in the horizontal direction in FIG. 3B) corresponding to a number of printed sheets as the usage of the ink-jet printing apparatus 10. It is noted that a solid line in FIG. 5 indicates a number of errors detected as the edge of the printing material 12 as the optical sensor 60 degrades corresponding to the number of printed sheets. The correction value storing section 120 stores the correction values equal to or larger than the degree of error. As shown in FIG. 5, with the increase of the usage of the ink-jet printing apparatus 10, the correction value storing section 120 stores the correction values that presuppose that the printing material 12 exists more on the outside of the printing material 12 than the result detected by the optical sensor 60. Accordingly, as the usage of the ink-jet printing apparatus 10 increases, the correcting section 130 corrects the result on the supposition that the printing material 12 exists more on the outside of the printing material 12 than the result detected by the optical sensor 60. Thereby, even if the usage of the ink-jet printing apparatus 10 increases and the detecting precision of the optical sensor 60 varies as time elapses, the correcting section 130 can correct the detection result of the optical sensor 60 based on the correction value stored in the correction value storing section 120, thus enabling the ink-jet printing apparatus 10 to detect whether or not the printing material 12 exists, or more specifically, the edge of the printing material 12. Still more, in the mode shown in FIG. 5, the position of the optical sensor 60 is detectable with resolution of 720 dpi by the encoder 52, so that the correction value storing section 120 stores the correction values of integer times of the resolution, i.e., of 720 dpi. Thereby, the ink-jet printing apparatus 10 can accurately detect the edge of the printing material 12 in the width direction to the limit of detecting resolution of the optical sensor 60.

Figure 6:
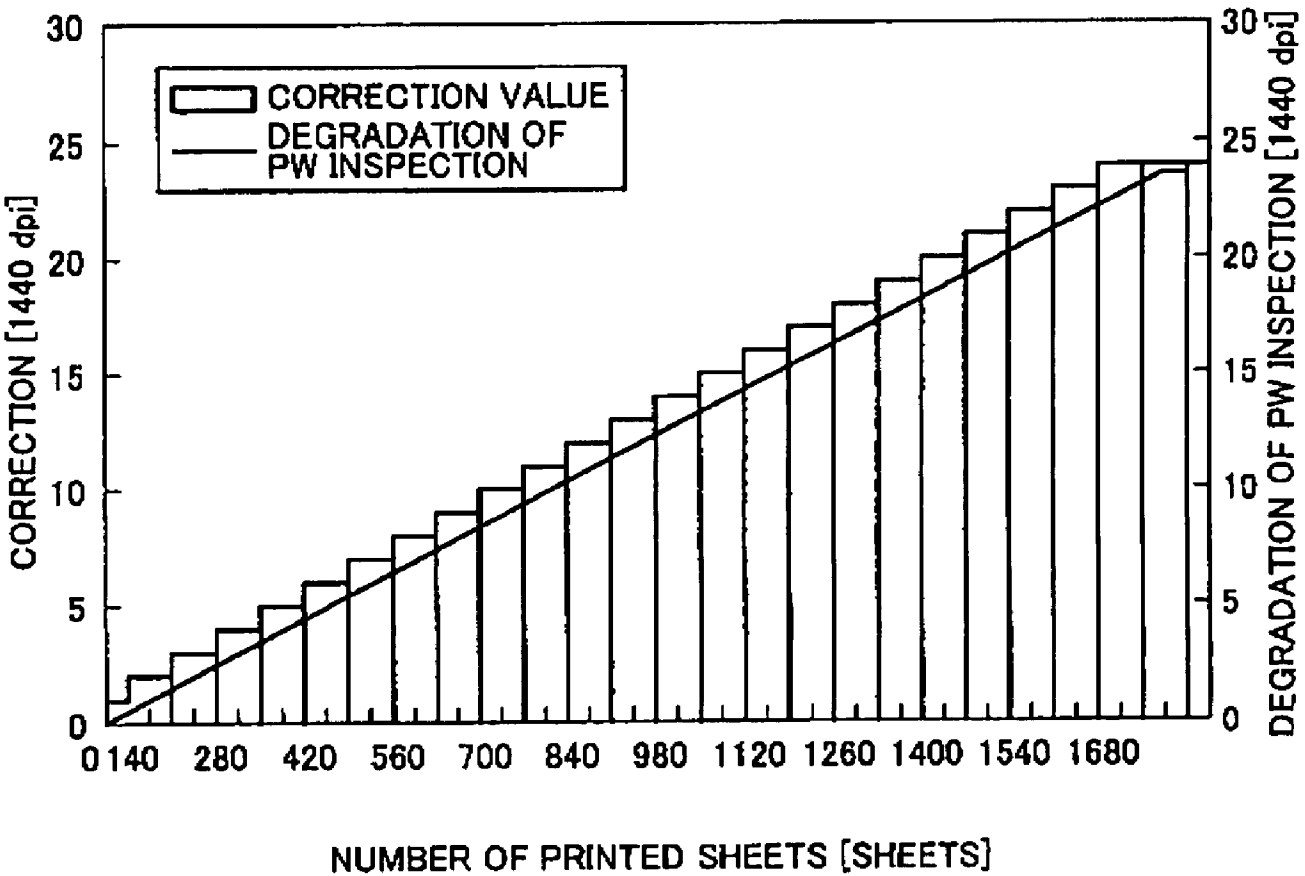
FIG. 6 is a graph showing other exemplary correction values stored in the correction value storing section.

FIG. 6 is a graph showing other exemplary correction values stored in the correction value storing section 120. The correction value storing section 120 shown in connection with FIG. 6 stores correction values in a longitudinal direction (in the vertical direction in FIG. 3B) of the printing material 12 corresponding to a number of printed sheets as the usage of the ink-jet printing apparatus 10. It is noted that FIG. 6 shows a number of errors detected as the front or rear edge of the printing material 12 as the optical sensor 60 degrades corresponding to the number of printed sheets by a solid line in the same manner with FIG. 5. The correction value storing section 120 stores the correction values equal to or larger than the degree of errors. Thereby, even if the usage of the ink-jet printing apparatus 10 increases and the detecting precision of the optical sensor 60 degrades as time elapses, the correcting section 130 can correct the detected result of the optical sensor 60 based on the correction value storing section 120, thus enabling the ink-jet printing apparatus 10 to accurately detect whether or not the printing material 12 exists or more specifically the front and rear edges of the printing material 12. Still more, in the mode shown in FIG. 6, the position of the optical sensor 60 is detectable with resolution of 1440 dpi based on the conveyance of the sub-scan driving circuit 154. This resolution is twice of that shown in FIG. 5. The correction value storing section 120 stores the correction values of integer times of this resolution, i.e., 1440 dpi. Thereby, the ink-jet printing apparatus 10 can accurately detect the position of the front and rear edges of the printing material 12 to the limit of detecting resolution of the optical sensor 60.

Next, a second embodiment of the invention will be explained with reference to FIGS. 7 through 10.

Figure 7:
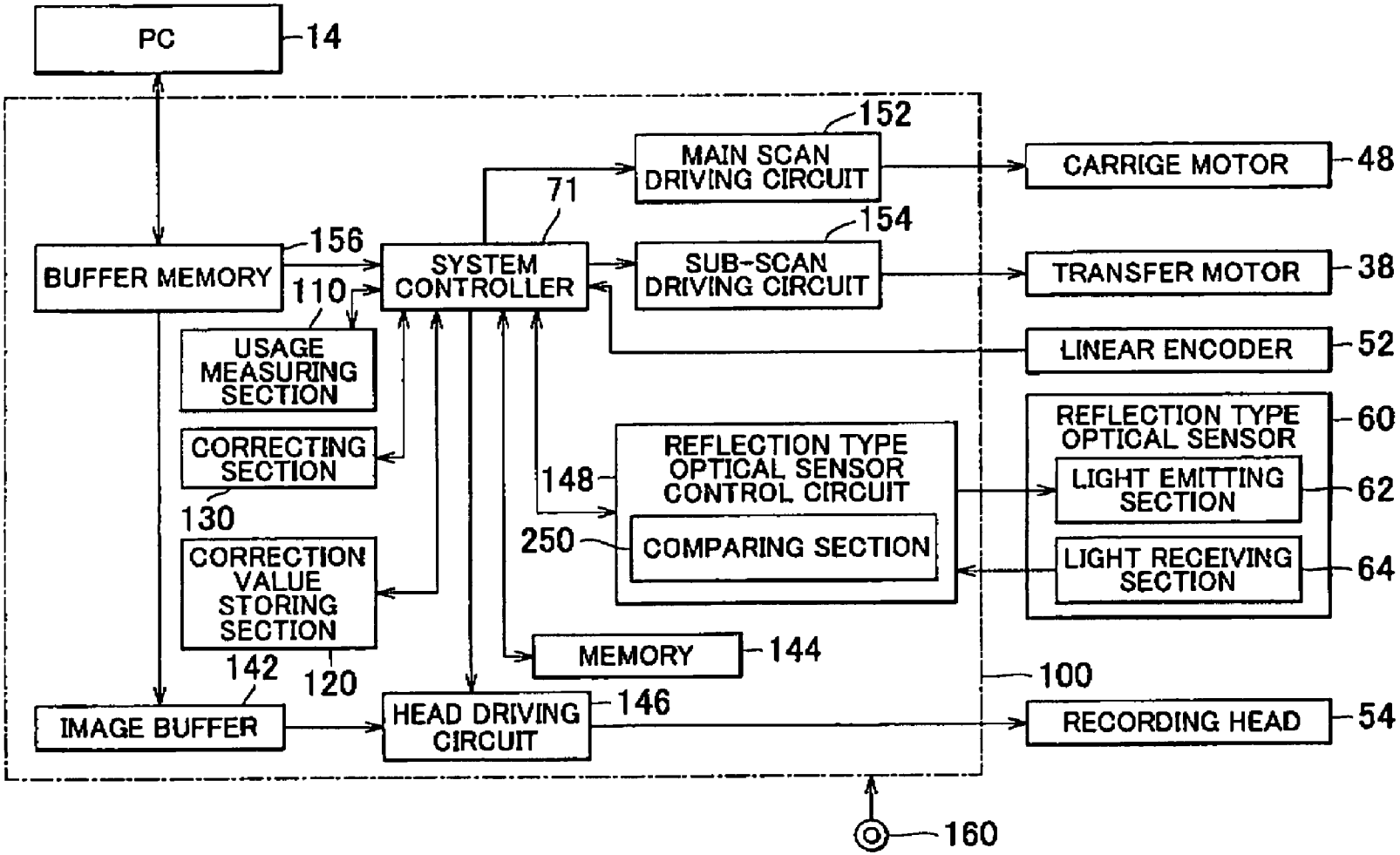
FIG. 7 is a block diagram showing functional blocks of the control section of the ink-jet printing apparatus.

FIG. 7 is a block diagram showing functional blocks of the control section 100 of the ink-jet printing apparatus 10. In FIG. 7, the same components and functions will be denoted by the same reference numerals and an explanation thereof will be omitted here. In the embodiment shown in FIG. 7, the optical sensor control circuit 148 has a comparing section 250 for measuring the electrical signal transduced from the reflected light received by the light receiving section 64 and for comparing the measured electrical signal with the threshold value.

The control section 100 also has the usage measuring section 110 for measuring the consumed amount of the ink-jet printing apparatus 10, the correction value storing section 120 for storing correction values by correlating with the usage of the ink-jet printing apparatus 10 and the correcting section 130 for correcting the threshold value of the comparing section 250 by making reference to the correcting section 130 based on the measured amount of the usage measuring section 110. Here, in the present embodiment, the usage measuring section 110 counts a number of sheets of the printing material 12 printed by the ink-jet printing apparatus 10 and calculates it as the usage of the ink-jet printing apparatus 10. Corresponding to that, the correction value storing section 120 stores the correction values by correlating with the number of sheets of the printing material 12.

Still more, the correcting section 130 reads the correction values out of the correction value storing section 120 by making reference to the correction value storing section 120 based on the number of sheets of the printing material 12 counted by the usage measuring section 110 to correct the threshold value to be referred by the comparing section 250. The comparing section 250 compares the threshold value with the electrical signal based on the luminous energy of light received by the light receiving section 64 while making reference to the threshold value corrected by the correcting section 130. The comparing section 250 determines a range from the edge detected based on the corrected threshold value to position of a predetermined margin as the range to which the ink is to be ejected and passes it to the system controller 140. Thereby, the edgeless printing may be carried out with less margin even when the detecting precision of the optical sensor 60 is low.

The recording medium 160 stores programs for operating the usage measuring section 110, the correction value storing section 120, the correcting section 130 and the comparing section 250. The control section 100 may operate the usage measuring section 110, the correction value storing section 120, the correcting section 130 and the comparing section 250 by installing the programs stored in the recording medium 160. As another method, the control section 100 may obtain such programs via communication lines.

Figure 8:
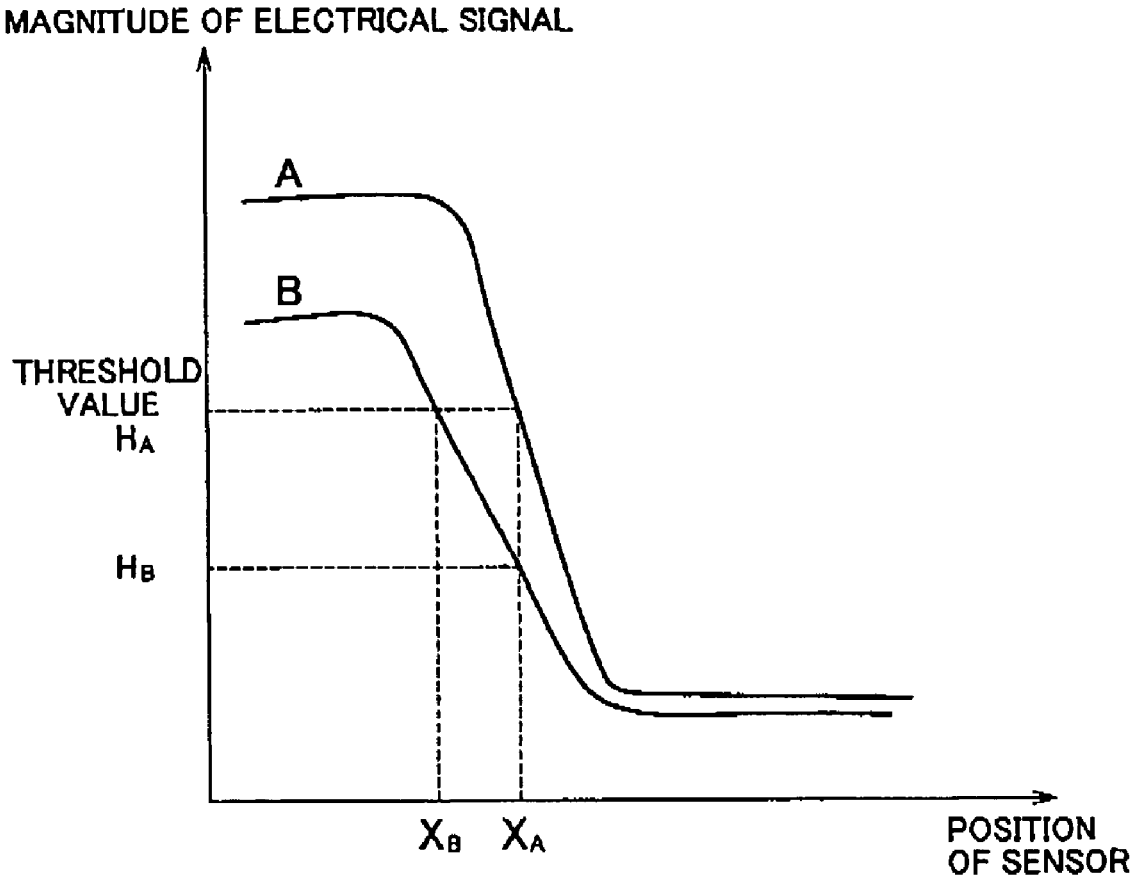
FIG. 8 is a graph for explaining a relationship between position (distance from home position) of the optical sensor and magnitude of electrical signals of a comparing section.

FIG. 8 is a graph for explaining a relationship between position (distance from the home position) of the optical sensor 60 and magnitude of the electrical signal of the comparing section 250 when the luminous energy of light received by the light receiving section 64 is measured by transducing to the electrical signal in the comparing section 250. When the consumed amount of the ink-jet printing apparatus 10 is small and the detecting precision of the optical sensor 60 is not inferior, the electrical signal gradually changes at the right and left sides of position $X_A$ of the edge of the printing material 12 along a curve A as shown in FIG. 8 when the optical sensor 60 moves in the direction of A as shown in FIG. 3A. Then, the system controller 140 measures the electrical signal of the comparing section 250 in advance based on the luminous energy of light received by the light receiving section 64 when the optical sensor 60 comes to the position $X_A$ of the edge of the printing material 12 and stores it in advance as an initial threshold value so as to be able to judge that the light receiving section 64 is located on the printing material 12 when the electrical signal based on the luminous energy of received light of the light receiving section 64 is greater than this initial threshold value and that the optical sensor 60 is located on the platen 56 when the electrical signal is smaller than that.

However, when the usage of the ink-jet printing apparatus 10 increases, the detecting precision of the optical sensor 60 degrades as the ink adheres on the light emitting section 62 and the light receiving section 64 of the optical sensor 60. For example, the magnitude of the electrical signal of the comparing section 250 based on the luminous energy of received light of the light receiving section 64 in the optical sensor 60 changes from the curve A to the curve B at certain usage as shown in FIG. 8. Then, the electrical signal of the comparing section 250 becomes equal with the initial threshold value set in the curve A when the optical sensor 60 comes to the position $X_B$ in the curve B. Therefore, with the increase of the consumed amount of the ink-jet printing apparatus 10 and the degradation of the detecting precision of the optical sensor 60, the electrical signal of the comparing section 250 becomes equal with the initial threshold value described above at the inner position of the printing material 12 from the original edge position $X_A$ of the printing material 12.

However, the correcting section 130 of the present embodiment corrects the threshold value based on the usage of the ink-jet printing apparatus 10. In this case, the correcting section 130 corrects the threshold value so that intensity of light becomes weak as the usage increases. Then the weaker the intensity of light, the smaller the magnitude of the measured electrical signal becomes in the example shown in FIG. 8, so that the correcting section 130 corrects so that the threshold value becomes smaller than the initial threshold value $H_A$. More specifically, the correcting section 130 reads out the usage measured by the usage measuring section 110, reads out the correction value stored in the correction value storing section 120 corresponding to this consumed amount and corrects the threshold value by subtracting this threshold value from the initial threshold value $H_A$. For example, corresponding to the consumed amount of the ink-jet printing apparatus 10 by which the electrical signal of the comparing section 250 becomes like the curve B in FIG. 8, the correcting section 130 reads out the correction value stored in the correction value storing section 120 and subtracts the correction value from the initial correction value to calculate the threshold value $H_B$.

The comparing section 250 compares the corrected threshold value $H_B$ with the magnitude (curve B) of the electrical signal based on the light received by the light receiving section 64 and judges that the edge of the printing material 12 exists at the position $X_A$ straddling the threshold value $H_B$. Thereby, it becomes possible to accurately detect whether or not the printing material 12 exists, or more specifically the edge of the printing material 12, even when the usage of the ink-jet printing apparatus 10 increases and the detecting precision of the optical sensor 60 varies as time elapses.

It is noted that although the case when the optical sensor 60 moves in the direction of the arrow A has been explained as an example, the correcting section 130 can correct the threshold value even when the optical sensor 60 moves in the opposite direction from the arrow A in the same manner with the case when the optical sensor 60 moves in the direction of the arrow A because the magnitude of the electrical signal of the comparing section 250 reaches the threshold value at the inner position of the printing material 12 as the accuracy of the optical sensor 60 degrades along with the usage of the ink-j et printing apparatus 10.

Figure 9:
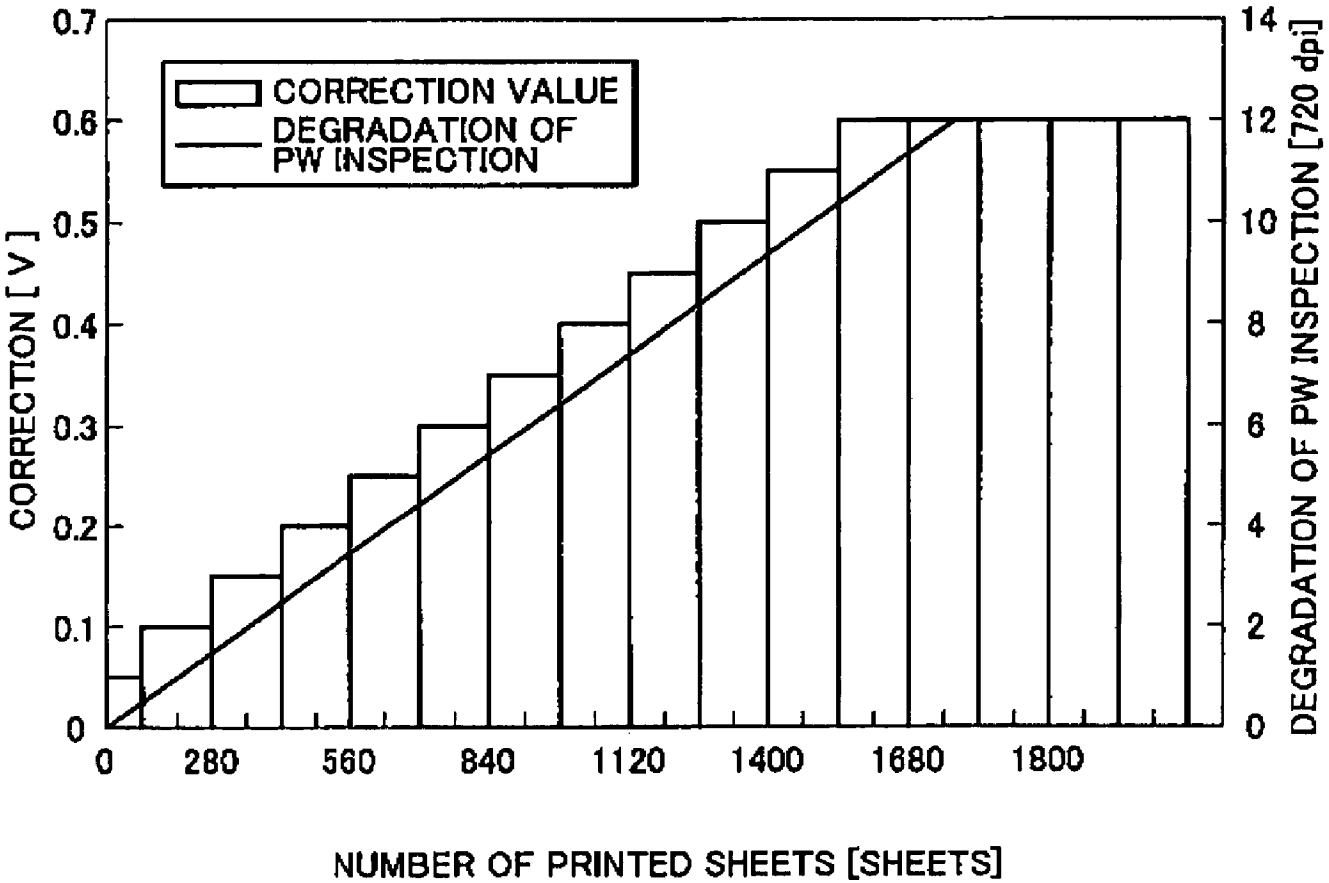
FIG. 9 is a graph showing exemplary correction values stored in the correction value storing section.

FIG. 9 is a graph showing exemplary correction values stored in the correction value storing section 120. The correction value storing section 120 shown in connection with FIG. 9 stores the correction values in the width direction of the printing material 12 (in the horizontal direction in FIG. 3B) corresponding to a number of printed sheets as the usage of the ink-jet printing apparatus 10. It is noted that a solid line in FIG. 9 indicates a number of errors detected as the edge of the printing material 12 as the optical sensor 60 degrades corresponding to the number of printed sheets. The correction value storing section 120 stores the magnitude of electrical signal equal to or larger than the number of errors. As shown in FIG. 9, with the increase of the usage of the ink-jet printing apparatus 10, the correction value storing section 120 stores the correction values that correct the threshold value in the direction in which the intensity of light is weakened.

Accordingly, the more the usage of the ink-jet printing apparatus 10 increases, the larger the value stored in the correction value storing section 120 becomes as the correction value to be subtracted from the initial threshold value $H_A$. Thereby, the comparing section 250 judges whether or not the printing material 12 exists based on the lower threshold value as the usage of the ink-jet printing apparatus 10 increases by making reference to the threshold value corrected by the correcting section 130. Thereby, even if the usage of the ink-jet printing apparatus 10 increases and the detecting precision of the optical sensor 60 varies as time elapses, the correcting section 130 can correct the threshold value based on the correction value storing section 120, thus enabling the ink-jet printing apparatus 10 to detect whether or not the printing material 12 exists or more specifically the edge of the printing material 12. Still more, in the mode shown in FIG. 9, the position of the optical sensor 60 is detectable with resolution of 720 dpi by the encoder 52, so that the correction value storing section 120 stores the correction values of integer times of the resolution, i.e., of 720 dpi. Thereby, the ink-jet printing apparatus 10 can accurately detect the edge of the printing material 12 in the width direction to the limit of detecting resolution of the optical sensor 60.

Figure 10:
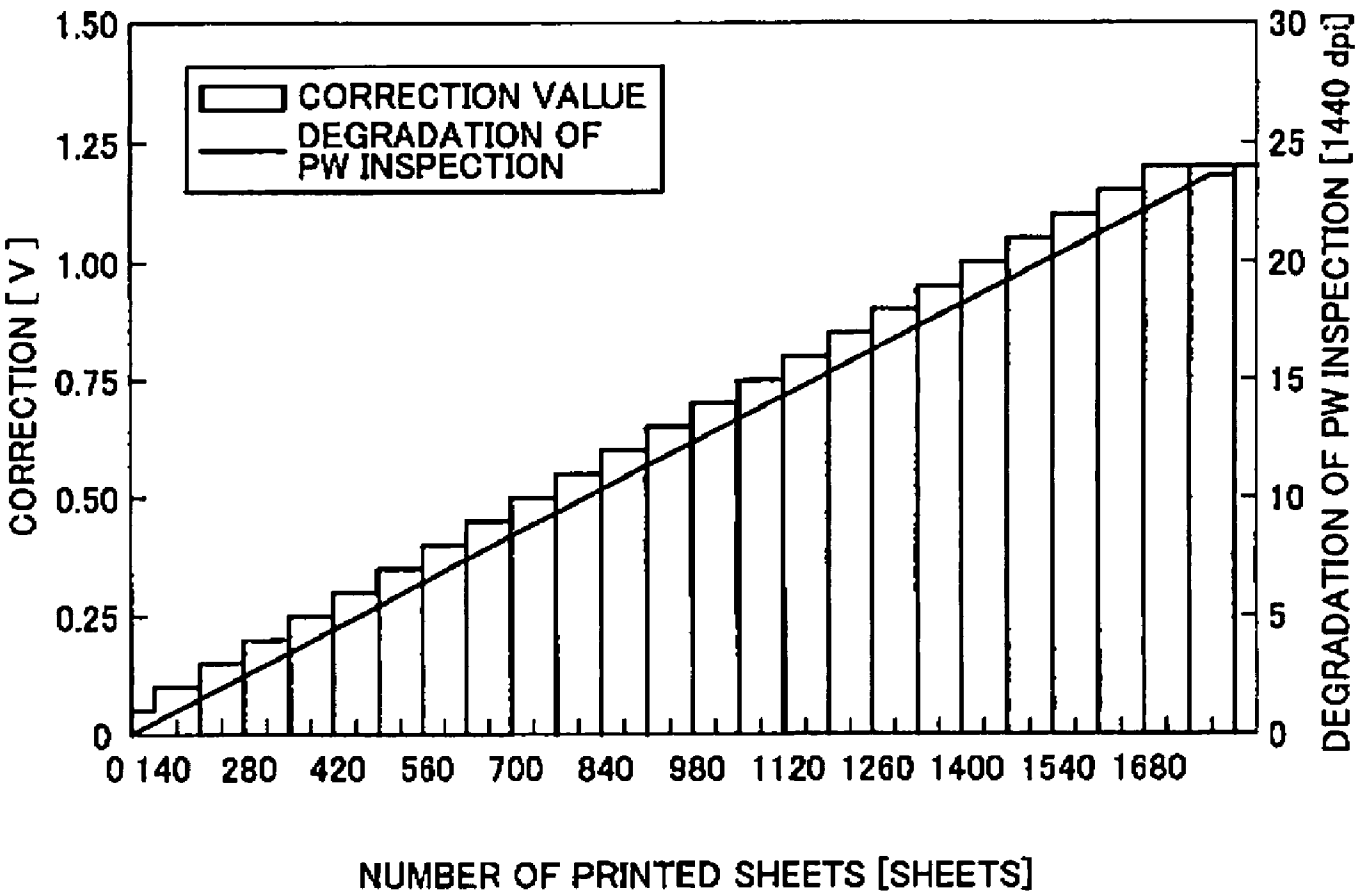
FIG. 10 is a graph showing other exemplary correction values stored in the correction value storing section.

FIG. 10 is a graph showing other exemplary correction values stored in the correction value storing section 120. The correction value storing section 120 shown in connection with FIG. 10 stores correction values in the longitudinal direction (in the vertical direction in FIG. 3B) of the printing material 12 corresponding to a number of printed sheets as the usage of the ink-jet printing apparatus 10. It is noted that FIG. 10 shows a number of errors detected as the front or rear edge of the printing material 12 as the optical sensor 60 degrades corresponding to the number of printed sheets by a solid line in the same manner with FIG. 9. The correction value storing section 120 stores the magnitude of electrical signals equal to or larger than the degree of errors. Thus, with the increase of the usage of the ink-jet printing apparatus 10, the comparing section 250 judges whether or not the printing material 12 exists based on the lower threshold value by making reference to the threshold value corrected by the correcting section 130. Thereby, even if the usage of the ink-jet printing apparatus 10 increases and the detecting precision of the optical sensor 60 degrades as time elapses, the correcting section 130 can correct the threshold value based on the correction value storing section 120, thus enabling the ink-jet printing apparatus 10 to accurately detect whether or not the printing material 12 exists or more specifically the front and rear edges of the printing material 12.

Still more, in the mode shown in FIG. 10, the position of the optical sensor 60 is detectable with resolution of 1440 dpi based on the conveyance of the sub-scan driving circuit 154. This resolution is twice of that shown in FIG. 9. The correction value storing section 120 stores the correction values based on a minimum unit proportional to this resolution, i.e., the correction values based on a minimum unit of a half of the minimum unit in FIG. 9. Thereby, the ink-jet printing apparatus 10 can accurately detect the position of the front and rear edges of the printing material 12 to the limit of detecting resolution of the optical sensor 60.

Thus, according to the embodiments shown in connection with FIGS. 1 through 10, the ink-jet printing apparatus 10 can accurately detect whether or not the printing material 12 exists or more specifically the edges of the printing material 12 even when the usage thereof increases and the detecting precision of the optical sensor 60 varies as time elapses. Accordingly, the margin into which the ink is ejected while overflowing out of the edges of the printing material 12 may be set to be small in implementing the edgeless printing on the printing material 12. It then allows the contamination caused by ink mist to be suppressed. It also allows the contamination of the optical sensor 60 to be suppressed and the detecting precision of the optical sensor 60 to be maintained. Still more, because it allows the printing area itself to be set small, an enlargement ratio of an image to be printed may be suppressed and a part of the image that overflows out of the printing material 12 and is not printed may be reduced. It is noted that the correction to the left edge of the printing material 12 has been explained in the embodiments described above, the same correction may be carried out also to the right edge of the printing material 12.

In the embodiments shown in FIGS. 1 through 10, the usage measuring section 110 counts the number of sheets of the printing material 12, the correction value storing section 120 stores the correction values corresponding to the number of sheets of the printing material 12 and the correcting section 130 corrects based on the number of sheets of the printing material 12 counted by the usage measuring section 110. However, the correction may be made based on another scale as the usage of the ink-jet printing apparatus 10. For example, the usage of the ink-jet printing apparatus 10 may be calculated based on an ejection amount of the ink ejecting out of the recording head 54. In this case, the usage measuring section 110 may measure an amount of the ink ejecting out of the recording head 54, the correction value storing section 120 may store the correction values corresponding to the amount of the ink ejecting out of the recording head 54 and the correcting section 130 may correct based on the ejection amount of the ink ejecting out of the recording head 54 and measured by the usage measuring section 110. Still more, the usage measuring section 110 may calculate the usage of the ink-jet printing apparatus 10 based on a printing mode indicating a text mode in which the ejection amount of the ink is relatively small or an image mode in which the ejection amount is relatively large. They allow the detection of existence of the printing material 12 to be corrected based on the contamination of the optical sensor 60 by ink, which is one factor of degrading the detecting precision of the optical sensor 60. Still more, the usage measuring section 110 may calculate the usage by measuring a light emitting time of the light emitting section 62 in the optical sensor 60. At this time, the usage measuring section 110 may calculate the light emitting time described above by measuring a power-on time. They allow the detection of whether or not the printing material 12 exists to be corrected based on the drop of the light emitting quantity, which is one factor of degrading the detecting precision of the optical sensor 60.

It is noted that the ink-jet printing apparatus 10 has been explained as one example of the liquid ejecting apparatus, the liquid ejecting apparatus of the invention is not limited to the ink-jet printing apparatus 10. As other examples of the liquid ejecting apparatus, there are a coloring agent ejecting device in the production of color filters for liquid crystal displays, an electrode forming apparatus in the production of FED (Face Emitting Display) and the like and a specimen ejecting apparatus used for manufacturing bio-chips.

Although the invention has been described by way of the exemplary embodiments, it should be understood that those skilled in the art might make many changes and substitutions without departing from the spirit and scope of the invention.

It is obvious from the definition of the appended claims that the embodiments with such modifications also belong to the scope of the invention.

What is claimed is:

1. A liquid ejecting apparatus for ejecting liquid to a printing material, comprising:

a platen for supporting said printing material;

an ejection head for ejecting the liquid to said printing material by reciprocating on said printing material supported by said platen;

an optical sensor reciprocating together with said ejection head and having a light emitting section that emits light toward said printing material and said platen and a light receiving section for receiving light reflected from said printing material to optically detect whether or not said printing material exists;

a usage measuring section for measuring usage of said liquid ejecting apparatus; and a correcting section for correcting a result detected by said optical sensor based on said usage measured by said usage measuring section.

2. The liquid ejecting apparatus as set forth in claim 1, wherein said correcting section corrects the result on the supposition that said printing material exists on the outside of the printing material detected by said optical sensor as said usage increases.

3. The liquid ejecting apparatus as set forth in claim 1, wherein said correcting section corrects the result detected whether or not said printing material exists in a direction in which said optical sensor reciprocates.

4. The liquid ejecting apparatus as set forth in claim 1, further comprising a transferring section for conveying said printing material in a direction crossing at right angles with the direction in which said optical sensor reciprocates; wherein said correcting section corrects the result detected whether or not said printing material exists in the direction in which said printing material is conveyed.

5. The liquid ejecting apparatus as set forth in claim 1, wherein said usage measuring section measures said usage by measuring a light emitting time of said light emitting section.

6. The liquid ejecting apparatus as set forth in claim 5, wherein said usage measuring section calculates said light emitting time by measuring a power-on time.

7. The liquid ejecting apparatus as set forth in claim 1, wherein said usage measuring section calculates said usage by measuring an ejection amount of the liquid ejecting out of said ejection head.

8. The liquid ejecting apparatus as set forth in claim 7, wherein said usage measuring section calculates said ejection amount by counting a number of sheets of said printing material.

9. The liquid ejecting apparatus as set forth in claim 7, wherein said usage measuring section calculates said ejection amount by measuring an amount of liquid ejecting out of said ejection head.

10. The liquid ejecting apparatus as set forth in claim 9, wherein said usage measuring section calculates the amount of said liquid based on an ejection mode.

11. The liquid ejecting apparatus as set forth in claim 1, wherein said correcting section minutely corrects the result when the detecting resolution of said optical sensor is high.

12. The liquid ejecting apparatus as set forth in claim 1, wherein said correcting section determines a range into which the liquid is ejected to said printing material based on the correction.

13. The liquid ejecting apparatus as set forth in claim 1, wherein said optical sensor further includes a comparing section for comparing intensity of light received by said light receiving section with a threshold value to optically detect whether or not said printing material exists; and said correcting section corrects said threshold value based on said usage measured by said usage measuring section.

14. The liquid ejecting apparatus as set forth in claim 13, wherein said correcting section corrects said threshold value in a direction in which the intensity of light is weakened as said usage increases.

15. The liquid ejecting apparatus as set forth in claim 13, wherein said correcting section corrects said threshold value in detecting whether or not said printing material exists in the direction in which said optical sensor reciprocates.

16. The liquid ejecting apparatus as set forth in claim 13, further comprising a transferring section for conveying said printing material in a direction crossing at right angles with the direction in which said optical sensor reciprocates, wherein said correcting section corrects a threshold value for detecting whether or not said printing material exists in the direction in which said printing material is conveyed.

17. A printing apparatus having a mechanism for transferring a printing material, comprising:

a platen for supporting said printing material supplied by the printing material transferring mechanism;

a print head for printing said printing material by reciprocating on said printing material supported by said platen;

an optical sensor reciprocating together with said print head and having a light emitting section that emits light toward said printing material and said platen and a light receiving section for receiving light reflected from said printing material to optically detect whether or not said printing material exists;

a usage measuring section for measuring usage of said printing apparatus; and a correcting section for correcting a result detected by said optical sensor based on said usage measured by said usage measuring section.

18. A liquid ejecting apparatus for supporting a printing material and ejecting liquid to the printing material, comprising:

an optical sensor for detecting whether or not the printing material is supported;

a usage measuring section for measuring usage of the liquid ejecting apparatus; and a correcting section for correcting for a degradation of the optical sensor based on the usage measured by said usage measuring section.

19. A liquid ejecting apparatus for supporting a printing material and ejecting liquid to the printing material, comprising:

an optical sensor for detecting whether or not the printing material is supported; a usage measuring section for measuring usage of the liquid ejecting apparatus; and a correcting section for compensating for degradation of said optical sensor based on the usage measured by said usage measuring section.

* * * * *